US009356368B2

(12) United States Patent
Chang et al.

(10) Patent No.: US 9,356,368 B2
(45) Date of Patent: May 31, 2016

(54) LOW PROFILE ELECTRICAL CONNECTOR

(71) Applicant: HON HAI PRECISION INDUSTRY CO., LTD., New Taipei (TW)

(72) Inventors: Yen-Chih Chang, New Taipei (TW); Nan-Hung Lin, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/446,348

(22) Filed: Jul. 30, 2014

(65) Prior Publication Data

US 2015/0037985 A1 Feb. 5, 2015

(30) Foreign Application Priority Data

Jul. 30, 2013 (TW) ..... 102127342

(51) Int. Cl.

| | |
|---|---|
| ***H01R 12/00*** | (2006.01) |
| ***H01R 12/70*** | (2011.01) |
| *H01R 4/04* | (2006.01) |
| *H01R 13/03* | (2006.01) |

(52) U.S. Cl.

CPC ..... *H01R 12/707* (2013.01); *H01R 12/7052* (2013.01); *H01R 4/04* (2013.01); *H01R 13/035* (2013.01)

(58) Field of Classification Search

CPC ..... H01R 23/722; H01R 23/6806; G01R 1/0483; H05K 7/1069; H05K 7/1061

USPC ..... 439/71, 68, 526, 558

See application file for complete search history.

(56) References Cited

U.S. PATENT DOCUMENTS

| | | | | | |
|---|---|---|---|---|---|
| 2,988,665 | A * | 6/1961 | Duran | C03C 27/046 | 29/885 |
| 3,033,919 | A * | 5/1962 | Aschinger | H02G 15/04 | 174/151 |
| 3,862,790 | A * | 1/1975 | Davies | H01L 23/5385 | 174/261 |
| 3,982,159 | A * | 9/1976 | Dennis | H01R 12/714 | 361/768 |
| 4,169,646 | A * | 10/1979 | Stape | H01R 12/675 | 439/395 |
| 4,395,084 | A * | 7/1983 | Conrad | H05K 7/1069 | 29/884 |
| 4,433,886 | A * | 2/1984 | Cassarly | H01L 23/552 | 257/E23.114 |
| 4,504,887 | A * | 3/1985 | Bakermans | H05K 7/1069 | 174/559 |
| 4,553,192 | A * | 11/1985 | Babuka | H05K 3/325 | 361/743 |
| 4,593,961 | A * | 6/1986 | Cosmo | H05K 7/1061 | 439/260 |
| 4,597,617 | A * | 7/1986 | Enochs | H05K 3/325 | 361/749 |

(Continued)

FOREIGN PATENT DOCUMENTS

TW M379877 5/2010

*Primary Examiner* — Abdullah Riyami
*Assistant Examiner* — Vladimir Imas
(74) *Attorney, Agent, or Firm* — Wei Te Chung; Ming Chieh Chang

(57) ABSTRACT

An electrical connector for electrically connecting a package with a printed circuit board (PCB) with a plurality of pads and an alignment feature includes an insulating housing, a plurality of contacts received in the insulating housing and a stiffener insert molding with the insulating housing. When the stiffener is assembled upon the alignment feature correspondingly, the contacts align with the pads of the PCB correspondingly.

19 Claims, 5 Drawing Sheets

(56) References Cited

U.S. PATENT DOCUMENTS 4,645,278 A * 2/1987 Yevak, Jr. ..... H01R 13/447 228/212
4,820,196 A * 4/1989 Roselle ..... H01R 13/405 174/76
5,009,608 A * 4/1991 Shipe ..... H05K 7/1061 439/331
5,049,084 A * 9/1991 Bakke ..... H01R 13/2435 439/591
5,062,802 A * 11/1991 Grabbe ..... H05K 7/1023 29/842
5,611,696 A * 3/1997 Donner ..... H01R 13/2435 439/66
5,629,837 A * 5/1997 Barabi ..... H01R 13/2407 174/261
5,730,620 A * 3/1998 Chan ..... H01R 23/72 439/526
5,885,101 A * 3/1999 Matsuoka ..... H01L 23/32 439/526
6,046,597 A * 4/2000 Barabi ..... G01R 1/0483 257/E23.078
6,431,877 B1 * 8/2002 Lemke ..... H01R 43/0256 439/70
6,485,321 B1 * 11/2002 Trout ..... H05K 7/1007 439/342
6,585,527 B2 * 7/2003 Koopman ..... H01R 13/2435 439/66
6,775,145 B1 * 8/2004 Chen ..... H01L 23/49861 174/521
6,796,847 B2 * 9/2004 AbuGhazaleh ..... H05K 1/0228 439/676
6,905,357 B2 6/2005 Ma
7,077,665 B2 * 7/2006 Kanesashi ..... H05K 7/1061 439/289
7,137,831 B2 * 11/2006 Okamoto ..... H01R 13/2407 439/66
7,195,493 B1 * 3/2007 Polnyi ..... H01R 12/7076 439/70
7,196,907 B2 * 3/2007 Zheng ..... H01R 13/2435 361/760
7,384,273 B1 * 6/2008 Polnyi ..... H01R 12/7052 439/526
7,484,964 B2 * 2/2009 Walker ..... H05K 7/1023 439/41
7,556,507 B2 * 7/2009 Kunioka ..... G01R 1/0433 324/756.02
7,654,862 B2 * 2/2010 Liao ..... H01R 13/2435 439/526
7,690,925 B2 * 4/2010 Goodman ..... H05K 7/1061 361/813
7,710,406 B2 * 5/2010 Fujii ..... G06F 3/0416 345/173
7,955,091 B2 * 6/2011 McClellan ..... H01R 13/629 439/66
8,202,134 B2 * 6/2012 Moon ..... H01M 2/0473 439/878
8,400,539 B2 * 3/2013 Silva ..... H04N 5/2253 348/294
8,870,611 B2 * 10/2014 Sato ..... H01R 4/185 439/442
2002/0182901 A1 * 12/2002 Koopman ..... H01R 13/2435 439/71
2007/0082513 A1 * 4/2007 Zheng ..... H05K 7/1069 439/70
2010/0120297 A1 * 5/2010 Niitsu ..... H01R 13/2442 439/708

* cited by examiner

LOW PROFILE ELECTRICAL CONNECTOR

BACKGROUND OF THE INVENTION

1. Field of the Invention

The present disclosure relates to an electrical connector, and more particularly to a low profile, fine pitch electrical connector.

2. Description of Related Art

Land grid array (LGA) electrical connectors are widely used in personal computer (PC) systems to electrically connect LGA chips with printed circuit boards (PCBs). U.S. Pat. No. 6,905,357 issued to Ma on Jun. 14, 2005 discloses a typical LGA electrical connector. The electrical connector comprises an insulating housing, a plurality of contacts received in the housing with contacting portions for contacting the LGA chip and soldering portions for soldering on the PCB, a metallic frame surrounding the insulating housing, a load plate and a load lever attached to the metallic frame. When using, the electrical connector is assembled on a PCB with soldering portion of the contacts corresponding soldering on a plurality of pads of the PCB. The LGA chip is assembled into the insulating housing and contacts the contacting portions of the contacts so as to establish an electrical connection therebetween.

However, with miniaturization of the electrical connector, the size of the insulating housing becomes smaller and smaller and the arrangement density of the contacts becomes higher and higher. So, it is difficult to align the contacts with corresponding pads of the PCB correctly. Another aspect, as the insulating housing become smaller, the strength of the insulating housing may be not good enough to meet the requirement.

In view of the above, an improved electrical connector is desired to overcome the problems mentioned above.

SUMMARY OF THE INVENTION

Accordingly, an object of the present disclosure is to provide a low profile, fine pitch electrical connector.

According to one aspect of the present disclosure, an electrical connector for assembling on a printed circuit board (PCB) having an alignment feature is provided. The electrical connector comprises an insulating housing, a plurality of contacts received in the insulating housing and a stiffener insert molding with the insulating housing, the stiffener align with the alignment feature and assembled on the PCB.

Other objects, advantages and novel features of the disclosure will become more apparent from the following detailed description when taken in conjunction with the accompanying drawings, in which:

DETAILED DESCRIPTION OF THE INVENTION

Reference will now be made to the drawings to describe a preferred embodiment of the present disclosure in detail.

Figure 1:
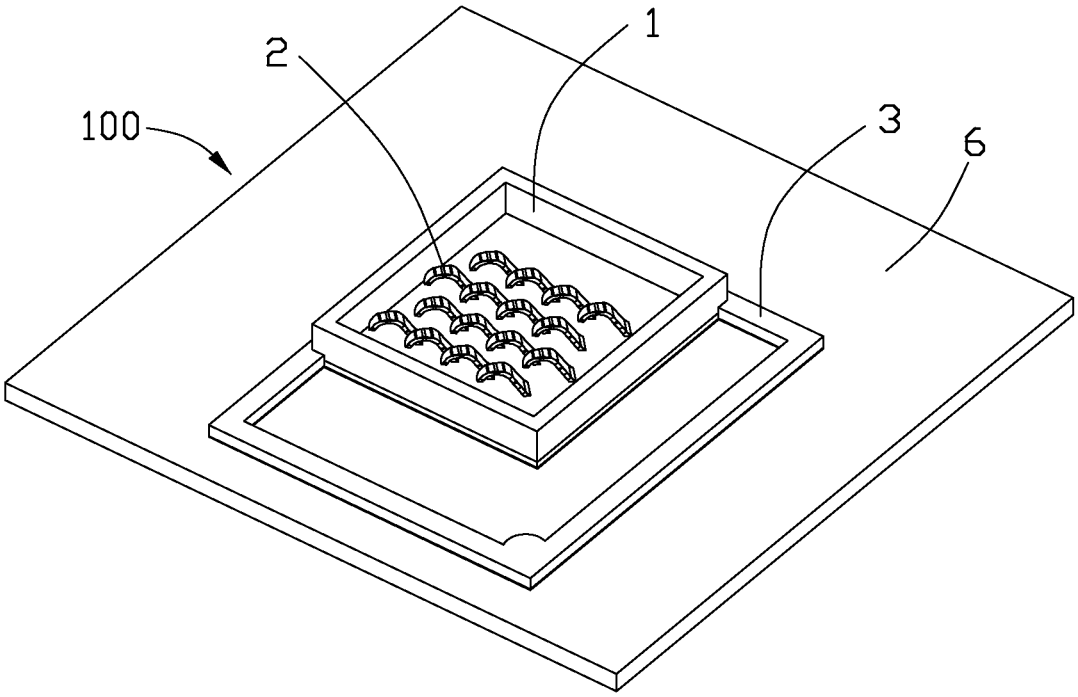
FIG. 1 is an assembled, perspective view of an electrical connector assembly in accordance with a preferred embodiment of the present disclosure.
Figure 2:
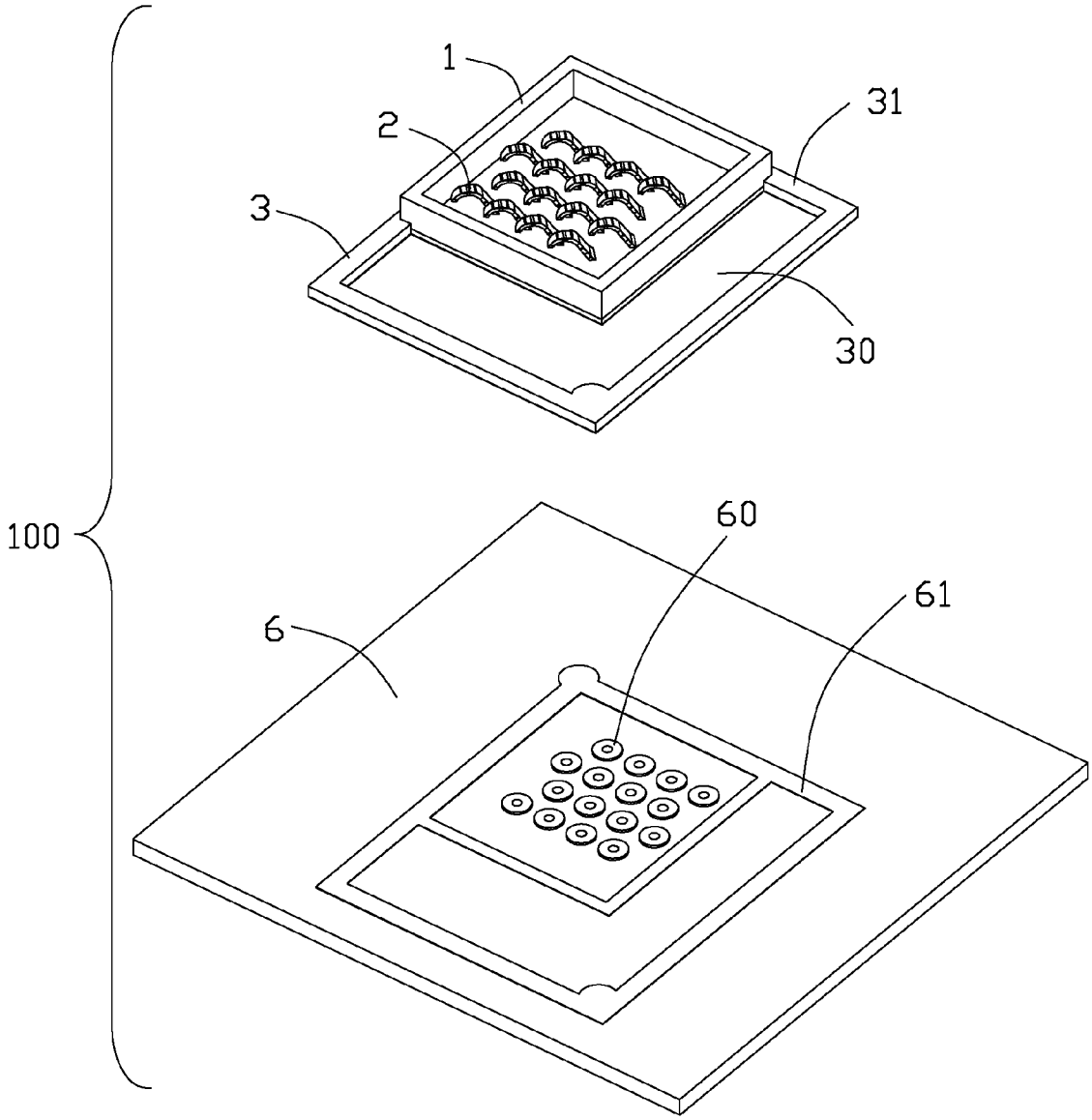
FIG. 2 is an exploded, perspective view of the electrical connector assembly as shown in FIG. 1.

Referring to FIGS. 1 and 2, an electrical connector assembly 100 for contacting a package (not show) comprises a printed circuit board (PCB) 6 and an electrical connector assembled on the PCB. The electrical connector comprises an insulating housing 1, a plurality of contacts 2 received in the insulating housing 1 and a metallic stiffener 3 insert molded with the insulating housing 1.

Figure 3:
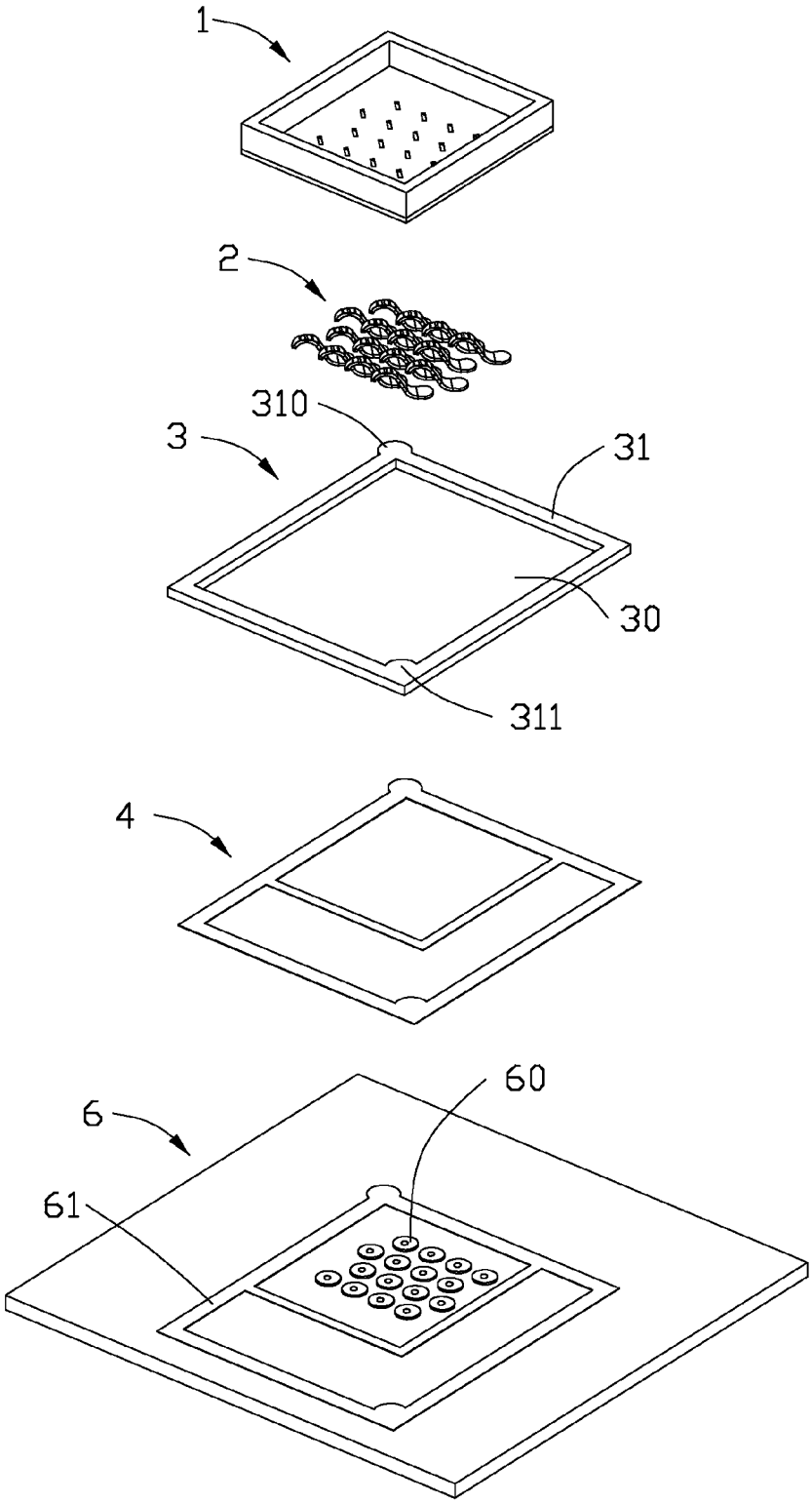
FIG. 3 is an exploded, schematic view of the electrical connector assembly as shown in FIG. 1.

Referring to FIG. 3, the metallic stiffener 3 is rectangular configuration, comprising four side portions 31 successively connecting one and another. The four side portions 31 define a cavity 30 for receiving the insulating housing 1. The stiffener 3 further comprises an outer protrusion 310 extending from the side portion 31 and far away from the cavity 30 and an inner protrusion 311 extending from the side portion 31 and into the cavity 30. In this embodiment, the outer protrusion 310 and the inner protrusion 311 are extending from corner of the metallic stiffener 3. The outer protrusion 310 and the inner protrusion 311 can enlarge the assembling surface and prevent the electrical connector from misassembling when assembling the electrical connector onto the PCB 6.

The insulating housing 1 is insert molding with the stiffener 3 for increasing the strength of the insulating housing 1. The insulating housing 1 locates into the cavity 30. From a top view, the area of the insulating housing is smaller than that of the cavity 30, i.e. the insulating housing 1 locates on partial of the cavity 30. In this embodiment, the insulating housing 1 locates on a corner of the stiffener 3.

Figure 4:
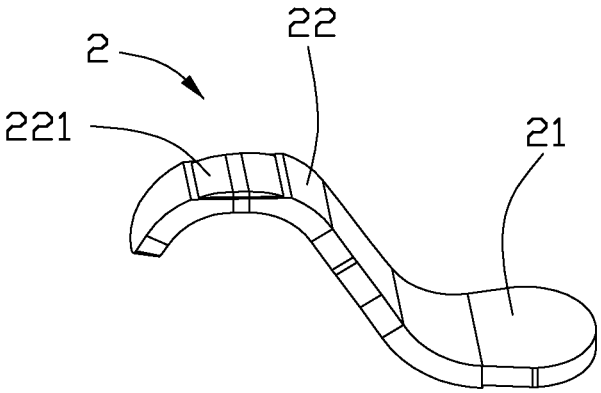
FIG. 4 is a perspective view of a contact as shown in FIG. 1.
Figure 5:
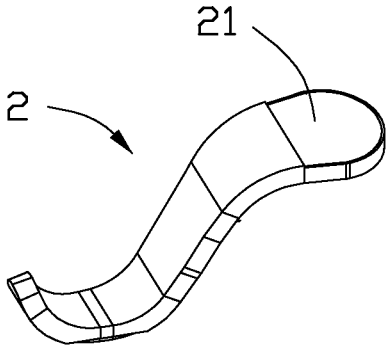
FIG. 5 is another view of the contact as shown in FIG. 4.

Referring to FIGS. 4 and 5, the contact 2 comprises a soldering portion 21 for soldering on the PCB 6 and an elastic arm 22 extending obliquely from the soldering portion 21. The elastic arm 22 comprises a contacting portion 221 for contacting the package. The contact 2 is coated with insulating layer except the contacting portion 221 and a bottom surface of the soldering portion 21. The insulating layer can prevent adjacent contact 2 from electrically connecting with each other and shortened so as to meet fine pitch arrangement requirement.

Referring to FIGS. 2 and 3, the PCB 6 comprises a plurality of pads 60 for contacting the contacts correspondingly. The PCB 6 comprises an alignment feature 61 surrounding the pads 60. The alignment feature 61 comprises a large frame having the same configuration with the frame 3 of the electrical connector. When assembling, just by aligning the stiffener 3 with the alignment feature 61 of the PCB 6 can align the contacts 2 in the insulating housing 1 with the corresponding pads 60 correctly. The alignment feature 61 further comprises a small frame corresponding to the configuration of the insulating housing 1, the insulating housing 1 covers on the small frame. The electrical connector is pasted on the PCB 6. Glue 4 is defined on a bottom surface of the stiffener 3 and periphery of the insulating housing 1. The glue 4 has the same configuration with the alignment feature 61. The stiffener 3 and the insulating housing 1 is pasted upon the alignment feature 61 correspondingly and the contacts 2 connect the pads 60 correspondingly by soldering materials or conducting glue.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. An electrical connector for assembling on a printed circuit board (PCB) having an alignment feature, comprising:

an insulating housing;

a plurality of contacts received in the insulating housing; and a stiffener insert molding with the insulating housing, the stiffener corresponding to the alignment feature and assembled on the PCB; wherein the stiffener is a metallic frame while the alignment feature has the same configuration with the metallic frame; wherein the stiffener defines a cavity, the insulating housing extends into the cavity, and wherein the area of the insulating housing is less than the area of the cavity from a top view.

2. The electrical connector as claimed in claim 1, wherein the stiffener comprises an outer protrusion extending far away from the cavity and an inner protrusion extending into the cavity.

3. The electrical connector as claimed in claim 1, wherein the contact comprises a soldering portion for assembling on the PCB and an elastic arm extending obliquely from the soldering portion, the elastic arm comprises a contacting portion for contacting a package, and wherein the contact is coated with insulating layer except the contacting portion and the soldering portion.

4. The electrical connector as claimed in claim 1, wherein the stiffener is pasted on the PCB.

5. The electrical connector as claimed in claim 1, wherein the contact is soldered on the PCB through soldering materials.

6. The electrical connector as claimed in claim 1, wherein the contact is pasted on the PCB through conducting glue.

7. An electrical connector assembly for contacting a package, comprising:

a printed circuit board (PCB), comprising a plurality of pads and an alignment feature around said plurality of pads;

an insulating housing having a plurality of contacts retained therein corresponding to said plurality of pads; and a stiffener having a plurality of side portions corresponding to the alignment feature of the PCB; wherein the stiffener and the insulating housing are fixed together, when the side portions of the stiffener is assembled upon the alignment feature correspondingly, the contacts align with the pads of the PCB correspondingly; wherein the stiffener is a metallic frame formed by four side portions connecting one with another and defining a cavity, the insulating housing extends into the cavity, and wherein the area of the insulating housing is less than the area of the cavity from a top view.

8. The electrical connector assembly as claimed in claim 7, wherein the alignment feature comprises a large frame having the same configuration with the stiffener and a small frame having the same configuration with the insulating housing.

9. The electrical connector assembly as claimed in claim 8, wherein the stiffener and the insulating housing are pasted upon the alignment feature correspondingly.

10. The electrical connector assembly as claimed in claim 7, wherein the stiffener and the insulating housing are insert-molded with each other.

11. The electrical connector assembly as claimed in claim 7, wherein the contact is coated with insulating layer except the portion for contacting the pad of the PCB and the portion for contacting the package.

12. An electrical connector assembly comprising:

a printed circuit board defining on a top surface a first frame structure enclosing a plurality of pads in a top view;

an electrical connector including a second frame structure insert-molded with an insulative housing, and aligned with and attached to the first frame structure in a vertical direction;

a plurality of contacts disposed in the housing and attached, in the vertical direction, to the corresponding pads, respectively.

13. The electrical connector assembly as claimed in claim 12, wherein both said first frame structure and said second frame structure are metallic.

14. The electrical connector assembly as claimed in claim 12, wherein each of the contacts is coated with an insulative layer except around an upper contact section for mating an electronic package upon the housing, and a lower contact section for contacting the corresponding pad.

15. The electrical connector assembly as claimed in claim 12, wherein the first frame structure is dimensioned similar to the second frame structure in the top view.

16. The electrical connector assembly as claimed in claim 12, wherein both said first frame structure and said second frame structure are formed continuously with interruptions thereof.

17. The electrical connector assembly as claimed in claim 12, wherein a glue is applied to an underside of the housing and an underside of the second frame structure to fasten the housing and the second frame structure to the first frame structure.

18. The electrical connector assembly as claimed in claim 12, wherein an area confined by the housing is smaller than that confined by the second frame structure.

19. The electrical connector assembly as claimed in claim 18, wherein a bottom portion of the housing is received within a cavity formed by the second frame structure.

* * * * *